US011077447B2

(12) United States Patent
Goetze et al.

(10) Patent No.: US 11,077,447 B2
(45) Date of Patent: Aug. 3, 2021

(54) MEAT GRINDER HAVING A HOUSING, AT LEAST ONE CONVEYING DEVICE, AND AT LEAST ONE CUTTING-UNIT PART, AND CUTTING-UNIT PART FOR SUCH A MEAT GRINDER

(71) Applicant: Turbocut Jopp GmbH, Bad Neustadt (DE)

(72) Inventors: Wolf Goetze, Bad Neustadt (DE); Norbert Sauer, Burgpreppach (DE); Udo Back, Reichenbach (DE); Hubert P Buechs, Leutershausen (DE)

(73) Assignee: Turbocut Jopp GmbH, Bad Neustadt (DE)

( * ) Notice: Subject to any disclaimer, the term of this patent is extended or adjusted under 35 U.S.C. 154(b) by 474 days.

(21) Appl. No.: 15/757,412

(22) PCT Filed: Aug. 12, 2016

(86) PCT No.: PCT/EP2016/069263
§ 371 (c)(1),
(2) Date: Mar. 5, 2018

(87) PCT Pub. No.: WO2017/036773
PCT Pub. Date: Mar. 9, 2017

(65) Prior Publication Data

US 2018/0243749 A1 Aug. 30, 2018

(30) Foreign Application Priority Data

Sep. 4, 2015 (DE) ..... DE102015114891.9

(51) Int. Cl.
*B02C 18/30* (2006.01)
*B02C 25/00* (2006.01)
(Continued)

(52) U.S. Cl.
CPC ..... *B02C 18/30* (2013.01); *B02C 18/301* (2013.01); *B02C 18/305* (2013.01); *B02C 18/36* (2013.01); *B02C 23/04* (2013.01); *B02C 25/00* (2013.01)

(58) Field of Classification Search
CPC ..... B02C 18/305; B02C 18/36; B02C 18/30; B02C 18/301; B02C 23/04; B02C 25/00
See application file for complete search history.

(56) References Cited

U.S. PATENT DOCUMENTS 6,382,539 B1 * 5/2002 Gulke ..... B02C 18/065 241/292.1
2002/0084368 A1 * 7/2002 Bernhardt ..... B02C 18/305 241/82.5

(Continued)

FOREIGN PATENT DOCUMENTS

DE 299204 A5 * 4/1992
DE 19534908 A1 * 9/1996 ..... B02C 18/065

(Continued)

OTHER PUBLICATIONS

English translate (DE19534908A1), retrieved date Nov. 14, 2020.*
English translate (DD299204A5), retrieved date Apr. 12, 2021.*

*Primary Examiner* — Adam J Eiseman
*Assistant Examiner* — Mohammed S. Alawadi
(74) *Attorney, Agent, or Firm* — Muirhead and Saturnelli, LLC

(57) ABSTRACT

A meat grinder, having a housing, a conveying device, and at least one cutting-unit part. A meat grinder according to the invention comprises a housing, at least one conveying device for conveying material to be ground from an inlet opening to an outlet opening, and at least one cutting-unit part arranged in the housing. At least one transponder is arranged in or on the at least one cutting-unit part and at least one communication device for communicating with the (Continued)

transponder is arranged in or on the housing in such a way that data exchange between the communication device and the transponder is enabled.

17 Claims, 2 Drawing Sheets

(51) Int. Cl.
*B02C 18/36* (2006.01)
*B02C 23/04* (2006.01)

(56) References Cited

U.S. PATENT DOCUMENTS

| | | | | |
|---|---|---|---|---|
| 2015/0069157 | A1* | 3/2015 | Wulf | A47J 43/046 241/46.17 |
| 2016/0214115 | A1* | 7/2016 | Bauer | B02C 18/301 |

FOREIGN PATENT DOCUMENTS

| | | | | |
|---|---|---|---|---|
| DE | 198 14 012 | A1 | 10/1999 | |
| DE | 100 54 028 | A1 | 5/2002 | |
| DE | 20 2007 003 778 | U1 | 6/2007 | |
| DE | 10 2011 008 389 | A1 | 7/2012 | |
| DE | 10 2013 220 137 | B3 | 3/2015 | |
| EP | 1 201 312 | A1 | 5/2002 | |
| EP | 1832346 | A2 * | 9/2007 | B02C 18/305 |

* cited by examiner

MEAT GRINDER HAVING A HOUSING, AT LEAST ONE CONVEYING DEVICE, AND AT LEAST ONE CUTTING-UNIT PART, AND CUTTING-UNIT PART FOR SUCH A MEAT GRINDER

TECHNICAL FIELD

The system described herein relates to meat grinding, and more particularly to a meat grinder having a housing, at least one conveying device and at least one cutting-unit part, as well as a cutting-unit part for such a meat grinder.

BACKGROUND OF THE INVENTION

A meat grinder is generally understood to be a device for pulverizing, grinding and/or mixing, usually organic, materials. Such materials include meat and other goods. Meat grinders usually comprise a feed opening (e.g. a filling funnel) for filling the meat grinder with the material to be processed and a conveying duct which is formed in a housing and has a conveying device. A screw conveyor, which is, for example, connected in a rotationally fixed fashion to a drive shaft or can be formed on a drive shaft, is usually used as a conveying device. The screw conveyor or other conveying device feeds the material which is filled in and is to be ground in the direction of the rotational axis of the drive shaft from a feed opening to an outlet opening. In the conveying region of the screw conveyor, in particular at the outlet of the screw conveyor, what are referred to as cutting-unit parts are generally arranged, these being either rotationally fixed with respect to the housing as fixed parts or connected in a rotationally fixed fashion to the drive shaft as rotating parts. A rotationally fixed connection to the drive shaft can be implemented, for example, by means of a positively locking plug-type connection between the drive shaft and the cutting-unit part which is to be driven by the drive shaft, in particular by using a profiled drive shaft (e.g. shaft with a flattened portion or a plurality of flattened portions or hexagon shaft) and by plugging on a correspondingly formed cutting-unit part. At least one perforated disk and at least one cutting blade are usually used as cutting-unit parts in a meat grinder. With respect to further cutting-unit parts, reference is made, in particular, to taper taps and supporting crosses. While perforated disks, supporting crosses and taper taps are generally secured in the housing, cutting blades are usually arranged in rotatable fashion and for this purpose connected in a rotationally fixed fashion to the drive shaft. Cutting blades therefore rotate at the same angular speed as the screw conveyor.

The material to be processed is in most cases conveyed by the conveying device, e.g. a screw conveyor, in the direction of a perforated disk which is arranged in front of the outlet opening, and is cut by means of at least one cutting blade before the perforated disk. All the cutting-unit parts are usually clamped to one another in the axial direction by means of a union nut. A plurality of cutting blade-perforated disk combinations can be arranged one behind the other.

It is to be noted that a meat grinder for special application can also be operated only with a cutting-unit part, in particular only with a perforated disk. The material which is pressed through the perforated disk can in this case, for example, be cut off as necessary manually after the perforated disk, or the material to be conveyed through the perforated disk is fed in portions, with the result that the cutting off of the quantities of material is regulated via the feed side.

DE 20 2007 003 778 U1 discloses a positioning and spacing ring for use in meat grinders, which positioning and spacing ring can be inserted between an end hole washer and a union nut. The ring has an encoded, electrically retrievable component identifier in the form of an RFID chip which is linked to a control system. It is to be possible to avoid activation of the meat grinder by means of the RFID chip and the control system if the positioning ring is not inserted correctly. There is no description of how the RFID chip is to be read out, and in the form presented it does not appear to be possible either according to the prior art. Furthermore, in the housing of a meat grinder a positioning ring is of secondary importance and is not necessary for a meat grinder to function.

It is desirable to increase the safety and the functionality of a meat grinder.

SUMMARY OF THE INVENTION

A meat grinder according to the system described herein comprises a housing, at least one conveying device for conveying material to be ground from an inlet opening to an outlet opening, and at least one cutting-unit part which is arranged in the housing. In some embodiments of the system described herein, at least one transponder is arranged in or on the at least one cutting-unit part, and at least one communication device for communicating with the transponder is arranged in or on the housing, in such a way that an exchange of data between the communication device and the transponder is made possible. A communication device is understood here to be, in particular, reading devices, writing devices and/or reading and writing devices which as reading devices can read out data from a transponder, and as writing devices can also transfer data actively to a transponder. The communication device and/or the transponder in some embodiments comprises an antenna, in particular for a simple and contactless exchange of data. RFID chips are particularly suitable as transponders, wherein, in some embodiments, passive RFID chips are used which do not require a separate energy source but instead can draw the energy necessary to use the RFID chip from a radiation field, in particular from a radiation field which is made available by the communication device. The safety and the functionality of a meat grinder can easily be increased by means of a meat grinder according to the system described herein, for example, as described below in detail.

In a practical embodiment of a meat grinder according to the system described herein, the communication device is arranged within the housing. Alternatively or in addition thereto, the transponder is arranged within the cutting-unit part. This arrangement has the advantage that, on the one hand, it takes up little installation space and, on the other hand, it permits a protected arrangement of the communication device and/or transponder, wherein particularly effective protection against external mechanical or other influences is provided if the communication device is arranged completely within the housing, or the transponder is arranged completely within the cutting-unit part. It is meant by this that the respective element, i.e. the communication device and/or the transponder is enclosed on all sides by the housing, the cutting-unit part and/or a further element, and therefore cannot come into direct contact with the material to be processed and/or other elements which could enter into contact with the housing and/or the cutting-unit part during their intended use. The communication between the transponder and the communication device can be implemented more reliably if the transponder and communication device are located directly opposite one another and are not enclosed by metal.

In a practical embodiment of a meat grinder according to the system described herein, at least a first anti-rotation element is arranged or formed in a housing of the meat grinder in order to arrange at least one cutting-unit part with a second corresponding anti-rotation element secured against rotation in the housing. A so-called housing-side sliding block which can be formed in one piece on the housing or arranged as a separate element in the housing, and a corresponding groove formed in a cutting-unit element, can serve as anti-rotation elements in meat grinders. However, other elements can also serve as anti-rotation means, in particular one or more projections which are shaped in any desired way and correspond to openings formed in the cutting-unit parts, and therefore ensure, on the one hand, that the respective cutting-unit part is inserted with a specific predefined orientation in the housing and, on the other hand, ensure that the inserted cutting-unit part cannot be rotated in the circumferential direction within the housing. In one embodiment of a meat grinder according to the system described herein, at least one communication device is arranged in or on the first anti-rotation element, and at least one transponder is arranged in or on the second corresponding anti-rotation element.

In meat grinders with a sliding block and cutting-unit parts with corresponding grooves, in some embodiments the first anti-rotation element is a sliding block, and the second anti-rotation element is a groove which corresponds with the sliding block. In a sliding block and a groove it is possible to integrate a communication device or a transponder in a secure, simple and cost-effective way, and in many cases even retroactively during the course of retrofitting of a meat grinder or cutting-unit part. In addition, in any meat grinder with a sliding block and groove it can be ensured that they can be arranged in the direct vicinity of one another.

Irrespective of whether a meat grinder has a sliding block and groove, or has some other type of anti-rotation means, or whether the meat grinder is of a different type, in some embodiments at least one transponder is inserted in an opening formed in the cutting-unit part, and/or at least one communication device is inserted in an opening formed in the housing. As well as the aspect of safety which has already been mentioned, such openings can also be easily and cost-effectively manufactured, in particular even retroactively, if sufficient material for forming an opening is present on the housing or on the cutting-unit part. The openings in cutting-unit parts can be formed from the outside when viewed in a radial direction. The transponders may be positioned as far to the outside as possible within the cutting-unit parts or on the cutting-unit parts. In cutting blades, the positioning can be effected, for example, on the outside of at least partially radially oriented cutting blades or cutting rotor blades.

If the opening is to be closed after the insertion of the transponder or the communication device, non-metallic materials, which do not adversely affect electrical and/or magnetic radiation fields, or will only do so to a small degree, may be most suitable. In particular, reference is made to materials which are safe with respect to foodstuffs, such as, for example, resins or adhesives which can be introduced into the opening in a liquid or at least flowable state and subsequently harden.

In a further practical embodiment of a meat grinder according to the system described herein, the opening formed in the cutting-unit part and the opening formed in the housing are arranged opposite one another. This is meant to refer, in particular, to an arrangement which permits at least one direct, i.e. linear, connection between a communication device inserted in the opening of a housing and a transponder inserted in the opening of a cutting-unit part, through the openings, in particular in such a way that no metallic element of the meat grinder intersects this direct opening. With such an arrangement it is possible, on the one hand, to use a communication device with only low power, since the distance between the communication device and the transponder can be selected to be very small. On the other hand, a high level of functional reliability in terms of the communication between the communication unit and the transponder occurs because the selected arrangement of the openings permits metallic interference influences from other elements of the meat grinder to be eliminated.

In a further practical embodiment of a meat grinder, the communication device has means for transmitting data to the transponder, and means for receiving data from the transponder, and is connected to an electronic circuit and/or a machine controller. In this case, the communication device and the transponder can be used to interrogate data relating to the cutting-unit parts and integrate said parts in a function-relevant and/or safety-relevant fashion into the electronic circuit and/or machine controller. In this respect, reference is made, in particular, to simple questions such as, for example, whether this cutting-unit part is inserted into a specific type of meat grinder which is to be capable of being operated, irrespective of the current purpose of use, only with a predefined cutting-unit part which is equipped with a transponder. For this purpose, the communication device can use the means for transmitting data to the transponder and the means for receiving data from the transponder to determine whether the cutting-unit part is present and to enable the electronic circuit or the machine controller to activate the meat grinder only when this condition is met. Therefore, with a meat grinder according to the system described herein, safety-relevant aspects can be implemented electronically by means of a communication device and transponder as well as a suitable connection to the abovementioned means for transmitting and receiving data. This makes it possible to dispense with mechanical protection elements which have the same effect and which are usually associated with higher manufacturing costs. In this respect, reference is made, in particular, to what is referred to as a leak protector for meat grinders, which could be dispensed with if the described electronic protection means ensures that the meat grinder can be activated only when a perforated disk with through-openings with a defined maximum diameter (for example 8 mm) is inserted on the outflow side. Detailed data (information) relating to the respective cutting-unit element can also be stored and updated on an RFID chip. In this respect, reference is made, in particular, to the manufacturer's name, type, date of manufacture, serial number, type of element, perforation pattern, times of use, machines (meat grinders) used, mode of operation of the meat grinder during the respective use, time when maintenance is carried out (maintenance intervals) etc.

In some embodiments of the system described herein, a meat grinder having the electronic circuit and/or machine controller mentioned above comprises a test module for carrying out safety-relevant and/or functional test procedures including the at least one transponder. The term "comprise" in this instance is to be understood here as meaning not only integration of the test module but also functional connection of such a test module to the electronic circuit and/or machine controller. By means of this test module it would be possible, for example, to query which cutting-unit parts are currently inserted in the meat grinder. It would additionally be possible to query the sequence in which the cutting-unit parts are inserted into the meat grinder. For this purpose on the one hand, it is possible to arrange, over the conveying distance of the meat grinder, a plurality of communication devices which the corresponding transponders interrogate at their respective position, and in this way determine which cutting-unit part is arranged at the respective location. Alternatively, a plurality of transponders can also be interrogated by means of a communication device and the position of the respective transponders can be determined by means of a proportional determination and/or by means of contents stored in the transponders.

In particular for the abovementioned proportional determination it may be advantageous if a communication device is arranged in the region of the outlet opening, because in this case the distance from each cutting-unit element with a transponder arranged therein or thereon is different. In this case, a coil antenna can be arranged in a particularly space-saving fashion in the housing of the meat grinder, in some embodiments with means for the direct or indirect measurement of the distance between the communication device and the emission location of the signals of one or more transponders within range of the communication device.

It is to be noted that the transponders—in particular RFID chips—can also be used for storage, updating and for retrieving information on cutting-unit parts, in particular wear-relevant information. In this respect, reference is made, in particular, to the service life and to set machine parameters during the service life of the individual cutting-unit parts. This information can be used, in particular in conjunction with a test module, on the one hand to indicate the need for individual cutting-unit parts to be exchanged, or to bring about such an exchange, and, on the other hand, to carry out, if appropriate, a check, by means of further communication connections, as to whether a spare part is available for the cutting-unit part to be exchanged, in an (in-house) storage facility. If this is the case, the cutting-unit part which is to be newly set can, if appropriate, be made available and/or inserted in a directly automated fashion. If this is not the case, if appropriate, automatic ordering of a cutting-unit part which is to be newly inserted can be initiated or offered. A meat grinder according to the system described herein can therefore be used functionally in a very versatile fashion.

Reference is also made to the following optional features of a meat grinder according to the system described herein, which can be implemented individually or in combination in addition to the features mentioned above:

a)

The conveying device comprises a drive shaft on which at least one cutting-unit part is arranged and secured in the axial direction by means of a union nut.

Such meat grinders are in practice found not only frequently but also can be used in a particularly flexible way since the number and sequence of the cutting-unit parts which are desired for a processing operation can be varied as desired, wherein the maximum number of cutting-unit parts which can be inserted into a meat grinder is predefined by the length of the housing region of the meat grinder into which cutting-unit parts can be inserted, in conjunction with the thickness of the cutting-unit elements which are measured in the conveying direction.

b)

The conveying device is a screw conveyor which is connected to a drive shaft or formed on a drive shaft and is mounted partially in the housing and partially opposite at least one cutting-unit part.

Such a bearing arrangement is implemented in practice in all meat grinders. Radial forces can advantageously be absorbed by the bearing arrangement of the drive shaft in one or more cutting-unit parts.

c)

At least one transponder is arranged in an outer region of a cutting-unit part.

The term outer region means, in particular, that region which, when measured from the rotational axis up to the respective outer circumferential point, extends over the outer 50 percent of the radius. The transponders are preferably arranged in the outer region extending over 30 percent of the radius, more preferably in the outer region extending over 20 percent and particularly preferably in the outer region extending over 10 percent. The further the transponders are arranged towards the outer circumferential point, the shorter is the distance to be spanned for signals to be exchanged between the transponder and the communication device.

d)

A display is provided for a user for function-relevant and/or safety-relevant information determined by means of the communication device and transponder.

Such a display can in a simple case be, for example, a check light which lights up as soon as it has been determined by means of the communication device and the transponder(s), optionally in conjunction with a test module, with a control device and/or with an electronic circuit, that a safety-relevant or functional condition is satisfied (or a plurality of safety-relevant and/or functional conditions are satisfied) and the meat grinder can be activated. It can additionally also involve graphic displays and/or displays of text messages, for example a display from which it is apparent which cutting-unit parts are currently inserted in which sequence in the housing, when which of the inserted cutting-unit parts has to be exchanged according to the schedule, and how the current cutting-unit arrangement is referred to (e.g. 3-part cutting-unit arrangement, 5-part cutting-unit arrangement etc.) and/or that it is an unknown cutting-unit arrangement or that specific cutting-unit parts are incorrectly arranged or that specific cutting-unit parts do not correspond to the necessary quality standard. The display can also comprise an input unit in order to give the users the possibility of making inputs or of confirming the reading of messages and of activating the meat grinder despite a fault message, notification or warning message.

e)

A read-only memory and/or a telecommunication device are/is provided.

A read-only memory and/or a telecommunication device can be used, in particular, to compare data of a transponder with data stored in a database. With such an arrangement it is possible, in particular in conjunction with access to a machine controller—to take electronic measures which are supplementary or replace mechanical protection means, by means of which electronic measures the safety or functionality of a meat grinder is increased further. In addition, information relating to a plurality of devices can be acquired and evaluated centrally without additional expenditure, in particular via the Internet and/or via radio link (e.g. mobile radio or WLAN).

f)

The arrangement of the at least one transponder in or on the cutting-unit part and of the at least one communication device in or on the housing takes place in such a way that a cutting-unit part which is not inserted correctly in the housing can be detected on the basis of the relative position of the transponder with respect to the communication device.

It is to be possible to detect, in particular, cutting-unit parts which are inserted backward and which while being inserted at the correct position within the meat grinder are however turned the wrong way round, i.e. through 180°. This can occur, in particular, as a result of an off-center arrangement of the transponder and/or the communication device. It is sufficient here if the transponder is implemented off-center in the conveying direction or transversely with respect to the conveying direction with respect to the arrangement off-center central axis, running in the conveying direction, of a sliding block.

If the arrangement is repeatedly off-center, the safety can be additionally increased.

The communication device can also be arranged outside the sliding block in the housing, for example at a different position than precisely opposite a single sliding block. In this case, a communication device which is installed in the housing and a transponder which lies precisely opposite in the correct installation position cannot lie opposite one another in the case of backward installation (i.e. installation turned through 180°) of the cutting-unit part. Such incorrect mounting can be detected directly by the communication device. This variant has the further advantage that the strength of the sliding block is completely retained since there is no need to make an opening for the arrangement of a communication device in the sliding block.

The system described herein also relates to a cutting-unit part for a meat grinder which is described as above, wherein a transponder is arranged in or on the cutting-unit part. The arrangement of the transponder on the cutting-unit part can be carried out in detail in a way as described above.

BRIEF DESCRIPTION OF THE DRAWINGS

Further practical embodiments are described below in conjunction with the drawings, in which:

FIG. 1 shows a section 10, embodied in a hollow-cylindrical fashion, of a housing 12 of a meat grinder (not illustrated in its entirety). A depression (e.g., a groove) 14, in which a sliding block 18 is inserted, is formed on the upper side of the housing 12 as a depression 14. The sliding block 18 forms an anti-rotation element (e.g., a projection) 26 which protrudes with respect to the inner wall 24 of the housing 12 and serves as an anti-rotation means 26 for cutting-unit parts. A cutting-unit part 22 which is inserted and is in the form of a perforated disk, illustrated in a highly simplified form, is shown in FIG. 1.

Figure 2:
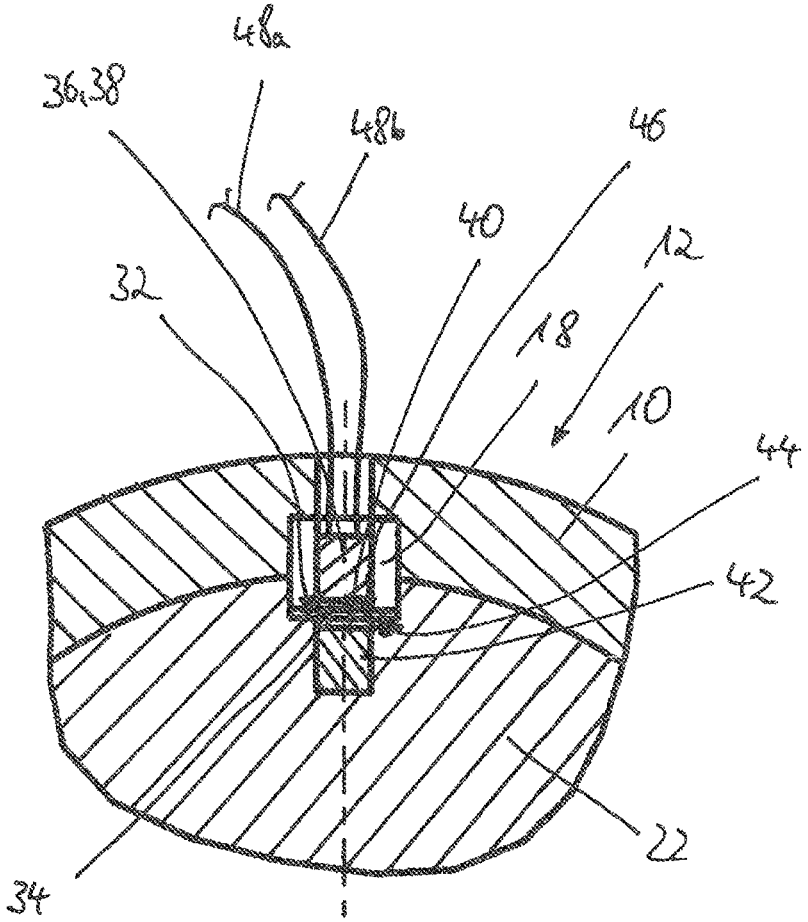
FIG. 2 shows the region of the housing, denoted II in FIG. 1, in a cross-sectional illustration in the region of the cutting-unit part according to some embodiments of the system described herein.

As is apparent from FIG. 2, a groove 32, which is shaped in a complementary fashion to the sliding block 18 of the housing 12, may be formed in the cutting-unit part (e.g., perforated disk) 22.

Figure 1:
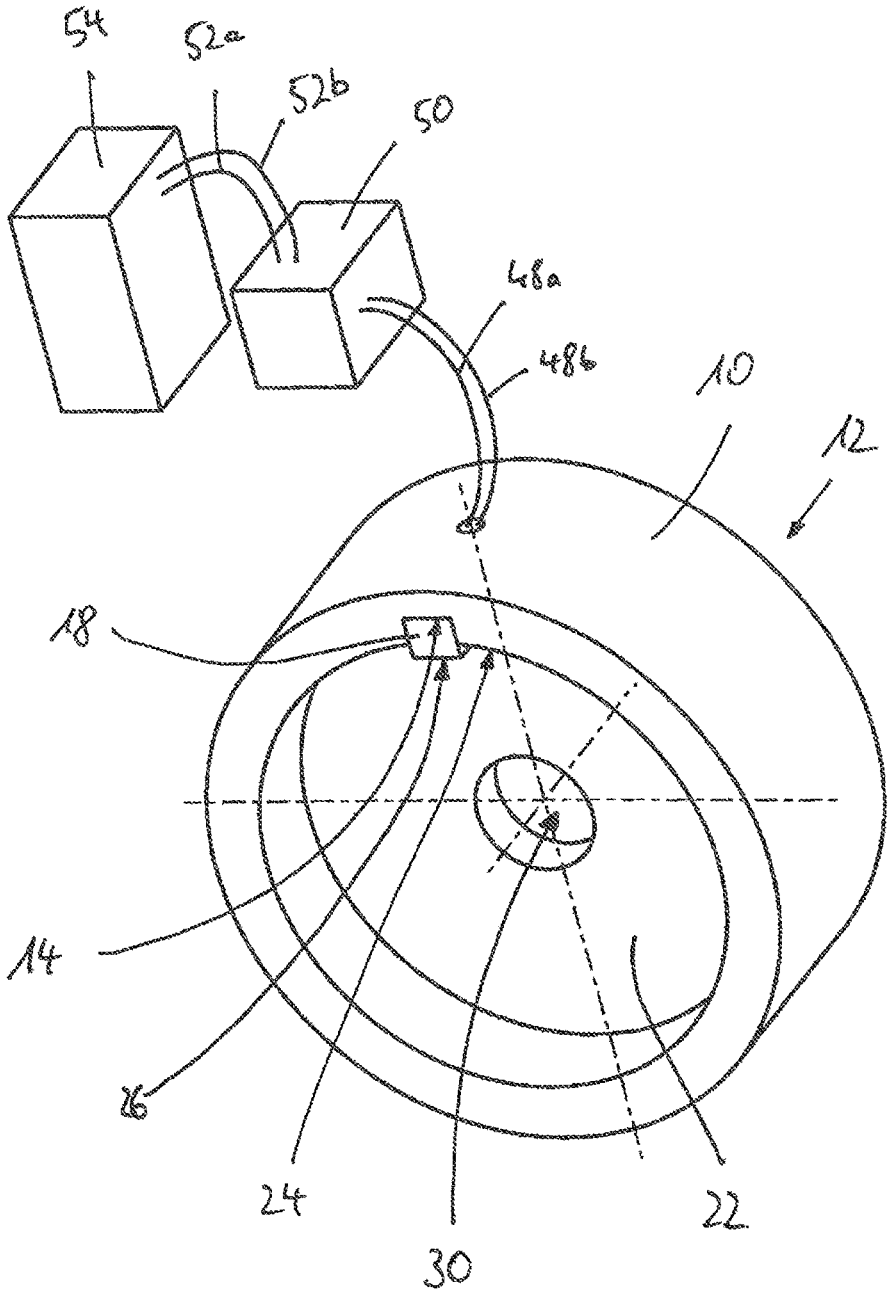
FIG. 1 shows a section of a housing of a meat grinder according to some embodiments of the system described herein with an inserted cutting-unit part in a perspective illustration and a schematic connection to an electronic circuit and a machine controller.

The cutting-unit part 22 illustrated in FIGS. 1 and 2 essentially may be in the form of a circular disk. The cutting-unit part 22 may have a concentrically arranged thro 30 which serves for the feeding through of a drive shaft (not illustrated). The drive shaft (not illustrated) can also be used to mount further elements of a meat grinder. The drive shaft is usually connected in a rotationally fixed fashion to a screw conveyor, and projects through all the cutting-unit parts. A union nut (not illustrated) ensures there is secure abutment of the cutting-unit parts one against the other through axial pressing of the cutting-unit parts. The perforated disks and supporting crosses are usually arranged fixed to the housing and are therefore mounted in a rotatable fashion with respect to the drive shaft. Taper taps and cutting blades are usually connected to the drive shaft in a rotationally fixed fashion and are driven by the drive shaft.

The sliding block 18 can extend over a relatively large longitudinal section of the meat grinder (considered in the conveying direction), in order to be able to serve for the rotationally fixed arrangement of a plurality of cutting-unit parts.

It is to be noted that, in contrast to the described illustrative embodiment, one or more anti-rotation elements (e.g., projections) 26 can also be formed integrally on the inner wall 24 of a housing 12 of a meat grinder. This corresponds functionally to the arrangement of a separate sliding block 18 in a depression (e.g., groove) 14. It is also possible to arrange a plurality of sliding blocks 18 in a housing 12 and/or a plurality of projections 24 can be formed in a housing 12, for example in order to make available a corresponding projection 24 for each cutting-unit part which is to be potentially secured fixed to the housing.

As is apparent from FIG. 2, in the illustrative embodiment an opening 34, into which a communication device 36 with an antenna 38 is inserted, is formed in the sliding block 18. In the cutting-unit part 22 (e.g., perforated disk) an opening 40 is also formed into which a transponder 42 is inserted.

As is apparent from FIG. 2, the communication device 36 and the transponder 42 each may be introduced completely into the corresponding openings 34, 40. In the present case, the communication device 36 and the transponder 42 even may be inserted so far into the corresponding openings 34, 40 that a free space remains between the communication device 36 and the side wall 44, directed toward the conveying space, of the sliding block 18 or between the transponder 42 and the groove side 46 which points to the sliding block 18. These free spaces are filled in the embodiment shown with a material which is safe in terms of foodstuffs and is not illustrated, wherein an adhesive has been used in the present case. The transponder 42 and the communication device 36 therefore each may be surrounded, at least on the side facing one another, by an adhesive-filled gap which permits radio waves to exit.

As is apparent from FIG. 2, the openings 34, 40 which are formed in the sliding block 18 and in the groove 32 of the cutting-unit part (e.g., perforated disk) 22 may lie precisely one opposite the other. The width of the openings may be between approximately 3 mm and 10 mm, in particular for communication devices 36 which operate at frequencies in the range from 865 MHz to 869 MHz.

The (radial) distance between the communication device 36 and the transponder 42 may be less than 20 mm, or less than 10 mm or even less than 5 mm.

As is apparent from FIGS. 1 and 2, the communication device 36 may be connected via lines 48*a*, 48*b* to an electronic circuit 50 which is illustrated by way of example. The electronic circuit 50 is connected via lines 52*a*, 52*b* to a machine controller 54 (likewise illustrated by way of example). The electronic circuit 50 and the machine controller 54 may be arranged within the housing 12 (only partially illustrated in FIG. 1) of the meat grinder.

The features of the system described herein which are disclosed in the present description, in the drawings and in the claims, can be essential in some instances, either individually or in any desired combinations, for the implementation of the system described herein in various embodiments. This can be varied within the scope of the claims and taking into account the knowledge of a person skilled in the relevant art.

Other embodiments of the invention will be apparent to those skilled in the art from a consideration of the specification and/or an attempt to put into practice the system disclosed herein. It is intended that the specification and examples be considered as illustrative only, with the true scope and spirit of the invention being indicated by the following claims.

The invention claimed is:

1. A meat grinder having a housing and at least one cutting-unit part which is arranged in the housing, wherein at least one transponder is arranged within the at least one cutting-unit part which is arranged in the housing, and at least one communication device for communicating with the transponder is arranged within the housing, in such a way that an exchange of data between the at least one communication device and the at least one transponder is made possible, wherein the at least one communication device is connected to an electronic circuit or machine controller, wherein the at least one communication device interrogates data relating to the cutting-unit part and initiates action by the electronic circuit or machine controller based on the interrogation, and wherein at least a first anti-rotation element is arranged or formed in the housing, and a corresponding second anti-rotation element is formed in the at least one cutting-unit part, in order to arrange the cutting-unit part secured against rotation in the housing, and a first of the at least one communication device is arranged in the first anti-rotation element, and a first of the at least one transponder is arranged in the second anti-rotation element.

2. The meat grinder as claimed in claim 1, wherein the first anti-rotation element is a sliding block, and the second anti-rotation element is a groove which corresponds with the sliding block.

3. The meat grinder as claimed in claim 1, wherein the meat grinder has at least one of the following: a second of the at least one transponder inserted in a first opening formed in the cutting-unit part, and a second of the at least one communication device inserted in a second opening formed in the housing.

4. The meat grinder as claimed in claim 3, wherein the first opening and the second opening are arranged opposite one another.

5. The meat grinder as claimed in claim 1, wherein at least a first of the at least one communication device has means for transmitting data to the at least one transponder, and means for receiving data from the at least one transponder, and is connected to an electronic circuit and/or a machine controller.

6. The meat grinder as claimed in claim 5, wherein the electronic circuit and/or machine controller comprises a test module for carrying out safety-relevant and/or functional test procedures including the at least one transponder.

7. The meat grinder as claimed in claim 1, wherein the first communication device is arranged in the region of the outlet opening.

8. The meat grinder as claimed in claim 1, wherein in addition at least one of the following features is present:

(a) at least one transponder is arranged in an outer region of a cutting-unit part, (b) a display is provided for a user for function-relevant and/or safety-relevant information determined by means of the communication device and transponder, (c) the arrangement of the at least one transponder in the cutting-unit part, and of the at least one communication device in the housing takes place in such a way that a cutting-unit part which is not inserted correctly in the housing can be detected on the basis of the relative position of the transponder with respect to the communication device, and (d) a read-only memory and/or a telecommunication device are/is provided.

9. The meat grinder as claimed in claim 1, wherein the at least one transponder is arranged directly opposite of a location of the at least one communication device.

10. The meat grinder as claimed in claim 1, wherein there is no metal located between the at least one transponder and the at least one communication device.

11. The meat grinder as claimed in claim 10, wherein there is no solid element located between the at least one transponder and the at least one communication device.

12. The meat grinder as claimed in claim 1, wherein the meat grinder is arranged to have at least one conveying device for conveying material to be ground from an inlet opening to an outlet opening.

13. The meat grinder as claimed in claim 1, wherein in addition at least one of the following features is present:

a) the at least one cutting-unit part is arranged on a drive shaft of a conveying device for which the drive shaft is secured in the axial direction by means of a union nut, and b) the housing is arranged to partially mount therein, partially opposite at least one cutting-unit part, a conveying device that is a screw conveyor connected to a drive shaft or formed on a drive shaft.

14. A meat grinder comprising:

a housing; and at least one cutting-unit part arranged in the housing, including at least one transponder arranged within the at least one cutting-unit part, wherein at least one communication device for communicating with the transponder is arranged within the housing in such a way that an exchange of data between the communication device and the transponder is made possible, wherein at least a first anti-rotation element is arranged or formed in the housing, wherein a corresponding second anti-rotation element is formed in the at least one cutting-unit part, in order to arrange the cutting-unit part secured against rotation in the housing, wherein a first of the at least one communication device is arranged in the first anti-rotation element, and wherein a first of the at least one transponder is arranged in the second anti-rotation element.

15. The meat grinder as claimed in claim 14, wherein the first anti-rotation element is a sliding block, and the second anti-rotation element is a groove which corresponds with the sliding block.

16. A meat grinder comprising:

a housing; and at least one cutting-unit part arranged in the housing, including at least one transponder arranged within the at least one cutting-unit part, wherein at least one communication device for communicating with the transponder is arranged within the housing in such a way that a wireless exchange of data between the communication device and the transponder is made possible, wherein the at least one transponder is arranged within the at least one cutting unit part opposite the at least one communication device for communicating with the transponder arranged within the housing, wherein there is no metal located between the at least one transponder and the at least one communication device, and wherein at least a first anti-rotation element is arranged or formed in the housing, and a corresponding second anti-rotation element is formed in the at least one cutting-unit part, in order to arrange the cutting-unit part secured against rotation in the housing, and a first of the at least one communication device is arranged in the first anti-rotation element, and a first of the at least one transponder is arranged in the second anti-rotation element.

17. The meat grinder as claimed in claim 16, further comprising:

a first opening formed in the cutting-unit part within which a second of the at least one transponder is located; and a second opening formed in the housing within which a second of the at least one communication device is located, wherein the first opening and the second opening are closed by non-metallic materials that are safe with respect to foodstuffs.

* * * * *